US006914574B2

(12) United States Patent
Fourdeux et al.

(10) Patent No.: US 6,914,574 B2
(45) Date of Patent: Jul. 5, 2005

(54) MULTIBAND PLANAR ANTENNA

(75) Inventors: Henri Fourdeux, Corps-Nuds (FR); Françoise Le Bolzer, Rennes (FR); Ali Louzir, Rennes (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/332,431

(22) PCT Filed: Jul. 11, 2001

(86) PCT No.: PCT/FR01/02233

§ 371 (c)(1),
(2), (4) Date: Jan. 7, 2003

(87) PCT Pub. No.: WO02/07261

PCT Pub. Date: Jan. 24, 2002

(65) Prior Publication Data

US 2004/0090379 A1 May 13, 2004

(30) Foreign Application Priority Data

Jul. 13, 2000 (FR) ..... 00 09378
Dec. 19, 2000 (EP) ..... 004600722

(51) Int. Cl.[7] ..... H01Q 13/12
(52) U.S. Cl. ..... 343/769; 343/770
(58) Field of Search ..... 343/700 MS, 767, 343/768, 769, 770

(56) References Cited

U.S. PATENT DOCUMENTS 4,208,660 A * 6/1980 McOwen, Jr. ..... 343/769
4,947,178 A 8/1990 Shafai ..... 343/700
5,465,100 A * 11/1995 Remondiere et al. ..... 343/769
5,539,418 A * 7/1996 Egashira et al. ..... 343/712
5,714,961 A * 2/1998 Kot et al. ..... 343/769

FOREIGN PATENT DOCUMENTS

EP 0481048 4/1992 ..... H01Q/9/27
EP 0707357 4/1996 ..... H01Q/19/17

OTHER PUBLICATIONS

C. Chen et al. "Stripline–Fed Arbitrarily Shaped Printed–Aperture Antennas", IEEE Transactions on Antennas and Propagation, vol. 45, No. 7, Jul. 1, 1997, pp. 1186–1198.

* cited by examiner

*Primary Examiner*—Tho Phan
(74) *Attorney, Agent, or Firm*—Joseph S. Tripoli; Robert D. Shedd; Brian J. Cromarty

(57) ABSTRACT

The present invention relates to a multiband planar antenna comprising a first slot 1*a* dimensioned (R1) to operate at a first frequency f1 and fed by a feed line 12 positioned (Im1) in such a way that the slot lies in a short-circuit plane of the feed line, and at least one second slot 11 dimensioned (R2) to operate at a second frequency f2, the second slot being fed by the said feed line (Im2).

10 Claims, 4 Drawing Sheets

LINEAR POLARIZATION

CIRCULAR POLARIZATION

MULTIBAND PLANAR ANTENNA

Figure 1:
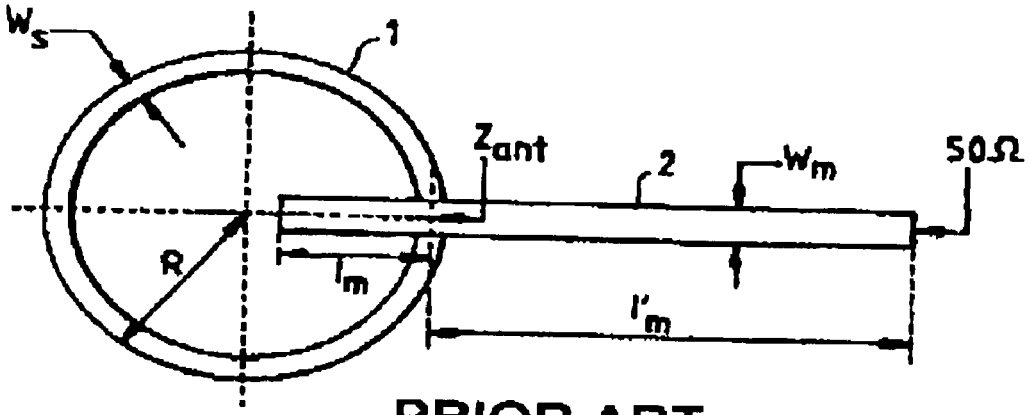
PRIOR ART FIG. 1

This application claims the benefit, under 35 U.S.C. § 365 of International Application PCT/FR01/02233, filed Jul. 11, 2001, which was published in accordance with PCT Article 21(2) on Jan. 24, 2002 in French and which claims the benefit of French patent application No. 00/09378 filed Jul. 13, 2000 and European patent application No. 00460072.2 filed Dec. 19, 2000.

FIELD OF THE INVENTION

The present invention relates to a broadband and/or multiband planar antenna, more especially an antenna matched to mobile or domestic wireless networks.

BACKGROUND OF THE INVENTION

Within the framework of the deployment of mobile or domestic wireless networks, the design of antennas is confronted with a particular problem which stems from the various frequencies allotted to these networks. Specifically, as shown by the non-exhaustive list below, the wireless technologies are numerous and the frequencies on which they are utilised are even more so.

| Technology | Application | Frequency Band (GHz) |
|---|---|---|
| GSM | Mobile telephone | 0.9 |
| DCS 1800 | Mobile telephone | 1.8 |
| UMTS | Universal mobile system | 1.9–2.0–2.1 |
| DECT - PHS | Domestic networks | 1.8 |
| Bluetooth | Domestic networks | 2.4–2.48 |
| Home RF | Domestic networks | 2.4 ISM |
| Europe BRAN/ HYPERLAN2 | Domestic networks | (5.15–5.35)(5.47–5.725) |
| US-IEEE 802.11 | Domestic networks | 2.4 |
| US-IEEE 802.11a | Domestic networks | (5.15–5.35)(5.725–5.825) |

Thus, the last 20 years have seen the installation of various mobile telephone systems carried on frequency bands which depend on both the operator and on the country of utilisation. More recently, one has witnessed the development of wireless domestic networks with, for certain technologies, a still evolving specification and frequency bands which differ from one continent to another.

From the user's point of view, this multitude of bands may constitute an obstacle to the obtaining of their services in so far as it involves the use of different connection devices for each network. This is why the current trend from the manufacturer's standpoint is aimed at reducing the host of devices by making them compatible with several technologies or standards. Thus we have seen the appearance, a few years ago now, of dual-band telephones which provide for connection both to the 900 MHz GSM and to the 1.8 GHz DCS. Moreover, the multiplicity of standards within the realm of wireless domestic networks is leading to a dividing up of frequency bands which are, either very far apart, or adjacent, depending on the standards under consideration.

In the future, the ever greater demand for frequency spectrum related to the explosion in digital bit rates, on the one hand, and to the scarcity of frequencies on the other hand, will give rise to equipment capable of operating in several frequency bands and/or over a broad band of frequencies.

Moreover, it would be beneficial to develop portable equipment which can be used as a mobile telephone when one is outside one's home and as an item of domestic equipment forming part of the domestic network when one returns home, namely cellular network/domestic network compatible equipment.

It would thus appear necessary to develop antennas operating on several frequency bands so as to allow this compatibility and which are moreover fairly compact.

A planar antenna is currently known which consists, as represented in FIG. 1, of an annular slot 1 operating at a given frequency f. This annular slot 1 is fed by a microstrip line 2.

It has become apparent, following simulations and trials, that if the microstrip line/radiating slot transition is made in such a way that the slot lies in a short-circuit plane of the line, that is to say in the zone where the currents are greatest, then the annular slot will exhibit resonances at all the odd multiples of this frequency, in contradistinction to line-fed structures of the <<patch>> type for which the resonances appear every even multiple of the fundamental frequency. This manner of operation justifies the following design rules which are used to make an antenna as represented in FIG. 1.

In this case, $$\lambda_s = 2\Pi R$$

$$Im = \lambda_m / 4$$

$$Zant. \approx 300\ \Omega$$

with $\lambda_s$ and $\lambda_m$ the wavelengths in the slot and under the microstrip line and Zant the input impedance of the antenna. Moreover, I'm represents the length of microstrip line required to produce matching at 50 Ω, $W_s$ and $W_m$ being the width of the slot and the width of the microstrip line respectively.

Figure 2:
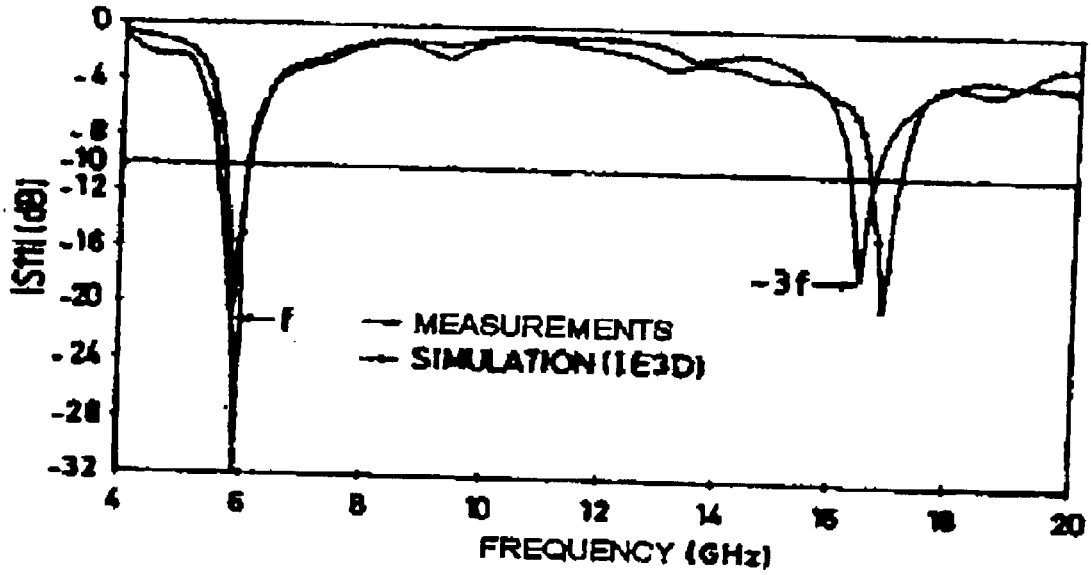
PRIOR ART FIG. 2

Thus, in the case of an antenna of the type of that of FIG. 1 made on a <<CHUKOH FLO>> substrate $\epsilon r = 2.6$–$\tan\delta = 0.002$–h=0.8 mm–copper th=15 $\mu$m with R=7 mm, $W_s = 0.25$ mm, Im=9.26 mm and operating at a fundamental frequency f of 5.8 GHz, frequency operation as represented in FIG. 2 is observed. A resonance is therefore observed at 5.8 GHz (f) followed by a second resonance at around 17 GHz, namely at 3f, the form of the reflection coefficient remaining flat in the 11 GHz region.

DETAILED DESCRIPTION OF THE PREFERRED EMBODIMENT

Based on the properties described above, the present invention proposes a novel broadband and/or multiband planar antenna structure of simple and compact design.

Thus the subject of the present invention is a multiband planar antenna of the type comprising a first slot dimensioned to operate at a first frequency f1 and fed by a feed line positioned in such a way that the slot lies in a short-circuit plane of the feed line, characterized in that it comprises at least one second slot dimensioned to operate at a second frequency f2, the second slot being fed by the said feed line.

According to a characteristic of the invention allowing multiband operation, the second slot lies in a short-circuit plane of the feed line.

Preferably, this antenna comprises N slots, each dimensioned to operate at a frequency $f_i$ with i varying from 1 to N, each slot being fed by the said feed line in such a way as to lie in a short-circuit plane of the feed line.

According to another characteristic of the invention allowing broadband operation, the two slots are cotangent at a point, the feed line being situated either level with this point, or opposite this point where the two slots are concentric.

According to one embodiment, the length of each slot is chosen so that the slot resonates at the said frequency $f_i$. Each slot may be of identical or non-identical shape, symmetric with respect to a point. Preferably, each slot is circular or square. The slot may be furnished with means allowing the radiation of a circularly polarized wave. These means consist, for example, of notches. In this case, depending on the position of the feed line, a right or left circularly polarized wave will be generated.

Figure 3:
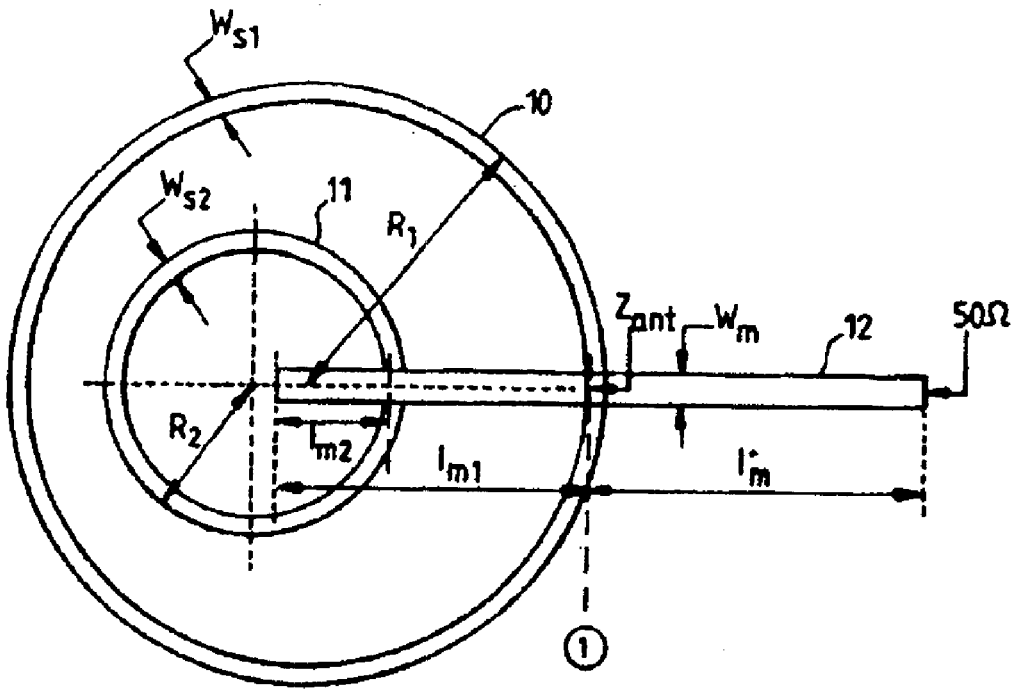
Figure 4:
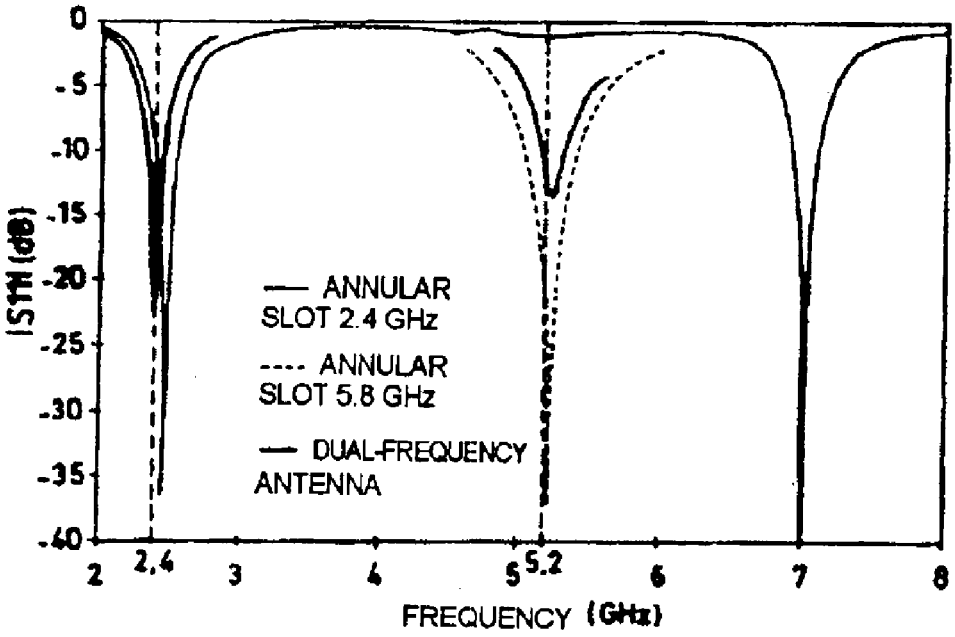
Figure 5:
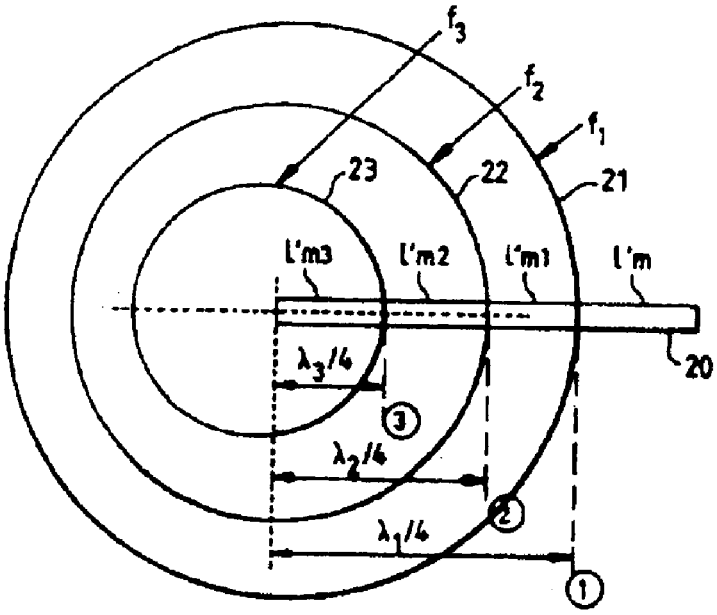
Figure 6A:
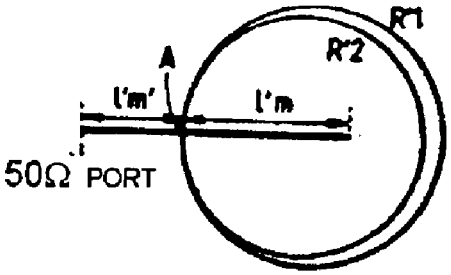
Figure 6B:
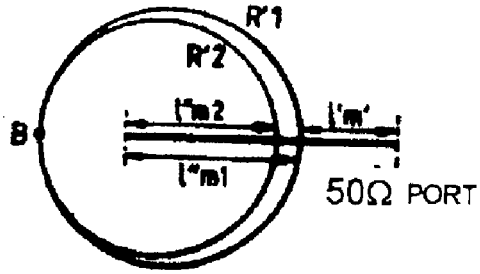
Figure 6C:
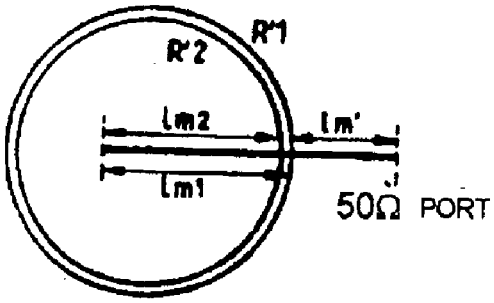
Figure 7:
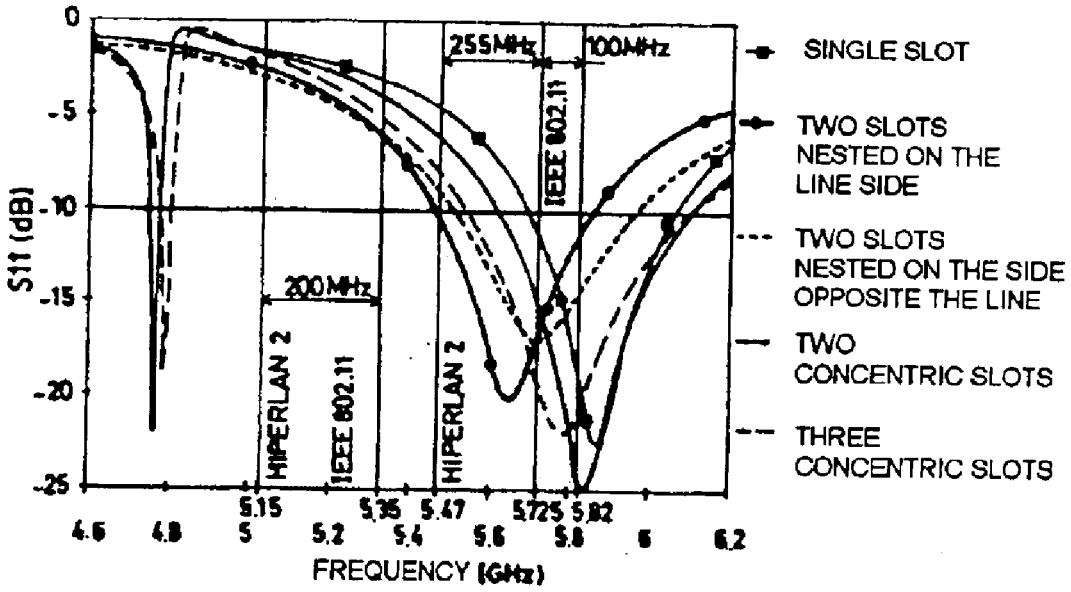

Other characteristics and advantages of the present invention will become apparent on reading the description of various embodiments, this description being given with reference to the appended drawings in which:

FIG. 1 already described represents a diagrammatic view from above of a known annular slot antenna, FIG. 2 is a curve giving the reflection coefficient as a function of frequency in the case of an antenna as represented in FIG. 1, FIG. 3 is a diagrammatic view from above of a dual-frequency planar antenna in accordance with the present invention, FIG. 4 is a curve giving the reflection coefficient as a function of frequency in the case of an antenna according to FIG. 3, FIG. 5 is a diagrammatic view from above of a three-frequency planar antenna in accordance with the present invention, FIGS. 6*a* to 6*c* are diagrammatic views from above of broadband planar antennas according to another embodiment of the present invention, FIG. 7 represents various curves giving the bandwidth of the antennas of FIGS. 1, 3, 5 and 6, FIGS. 8*a*, 8*b* and 8*c* diagrammatically represent various shapes of slot which can be used in the antennas of the present invention.

To simplify the description in the figures, the same elements bear the same references.

As represented in FIG. 3, a dual-frequency antenna in accordance with the present invention comprises a first annular slot 10 whose radius R1 is chosen so as to operate at a first fundamental frequency f1. Therefore, the radius R1 is equal to $\lambda_{s1}/2\Pi$ where $\lambda_{s1}$ is the wavelength in the slot 10. The slot 10 exhibits a width $W_{S1}$. The antenna also comprises a second annular slot 11 whose radius R2 is chosen so as to operate at a second fundamental frequency f2, the radius R2 being equal to $\lambda_{s2}/2\Pi$. In the embodiment, f2 is chosen close to 2f1 but other ratios may be envisaged.

In accordance with the present invention, the two annular slots 10 and 11 are fed by a single microstrip line 12. This microstrip line is placed in such a way that the slots lie in a short-circuit plane of the feed line. Therefore, the feed line 12 overshoots the slot 11 by a length Im2 equal to k(λm2/4) and the slot 10 by a length Im1 equal to k(3λm2/4)=k(λm1/4) where λm2 is the wavelength under the microstrip line at the frequency f2 and λm1 at the frequency f1 and k is an odd integer. Moreover, the length Im' represents the length of line required to match to 50 Ω the impedance Zant which is around 300 Ω. This line exhibits a width Wm. In a general manner, the length of the line such that the slot lies in a short-circuit plane is equal to kλm/4 with λm the wavelength under the microstrip line at the operating frequency defined for the slot and k an odd integer number.

Represented in FIG. 4 is the reflection coefficient of a structure such as represented in FIG. 3 with the following characteristics:

R1=16.4 mm $W_{S1}$=0.4 mm Im1=20 mm f1=2.4 GHz
R2=7.4 mm $W_{S2}$=0.4 mm Im2=9.25 mm f2=5.2 GHz

In this case, the microstrip line exhibits a width Wm=0.3 mm and a length I'm=20 mm. The assembly has been made on a substrate R4003 (εr=3.38, h=0.81 mm).

The simulation results obtained with the above structure are represented in FIG. 4. Note the dual-frequency operation of the novel topology with a very good matching at 2.4 GHz (S11=−22 dB) and an S11 which is entirely correct at 5.2 GHz (S11=−12 dB).

Moreover, with the above structure, it is thus observed that the radiation at 2.4 GHz is similar to that of the slot alone and perfectly symmetric. At 5.2 GHz a slight dissymmetry of the radiation is noted which, however, remains very limited.

Represented in FIG. 5 is an embodiment operating in three-band mode. In this case, three annular slots 21, 22, 23 operating at fundamental frequencies f1, f2, f3 are fed by one and the same microstrip line 20. The slots are made using the design rules given hereinabove. Thus, the radius of each annular slot is such that Ri (i=1,2,3)=λsi/2Π where λsi is the wavelength of each slot. Likewise, the short-circuit planes are positioned in such a way that Im3=k(λ3/4), Im2=k(λ2/4) and Im1=k(λ1/4) where λ1, λ2, λ3 are respectively the wavelengths under the microstrip line at the frequencies f1, f2 and f3 and where k is an odd integer. The length I'm is used for matching to 50 Ω.

Represented in FIGS. 6*a*, 6*b* and 6*c* is another embodiment of a planar antenna according to the present invention. In the case of FIGS. 6*a* and 6*b*, the two annular slots R'1 and R'2 merge at a point. They are dimensioned to operate at neighbouring frequencies. Thus, as represented in FIG. 6*a*, the antenna comprises two annular slots R'1 and R'2 cotangent at the point A.

In this embodiment, the two slots R'1 and R'2 are fed by a common line on the side of the point A. The two slots lie substantially in a short-circuit plane of the feed line and the lengths I'm and I'm' are chosen such that I'm is equal to kλ'm/4 where λ'm is the wavelength under the microstrip line and k an odd integer number and I'm' allows matching to 50 Ω.

According to the embodiment of FIG. 6*b*, the two annular slots are cotangent at the point B and are fed by a feed line on the opposite side from the point B.

In this case, the lengths I"m2 and I"m1 are chosen so that the slots R'1 and R'2 lie substantially in a short-circuit plane of the feed line. The length I"m' is chosen so as to produce the matching to 50 Ω. In the case of FIG. 6*c*, the two annular slots R'1 and R'2 are concentric. They are fed by a common feed line using microstrip technology, for example. In this case, the lengths Im1 and Im2 are chosen so that the slots R'1 and R'2 lie close to a short-circuit plane of the line and Im' allows matching to 50 Ω.

The study of the various topologies described above was carried out with the aid of simulation software known under the reference IE3D. In all cases, the size of the ground plane and of the substrate is assumed to be infinite. The geometrical characteristics of the various configurations tested are presented in the table below. Note that the use of multislot topologies is accompanied by an appreciable increase in the bandwidth.

The latter goes in fact from 380 MHz for the single slot, to 470 MHz and 450 MHz for the concentric and nested double slot structures.

TABLEAU II

Geometrical and electromagnetic characteristics of the antennas

| Antenna type | Dimension of the slots (mm) | Characteristics of the microstrip line (mm) | Frequency (GHz) | Bandwidth −10 dB (MHz) |
|---|---|---|---|---|
| Single slot | R = 6.5 | Im = 8.25 | 5.88 | 380 (6.55%) |
| 2 Concentric slots | R'1 = 7.1<br>R'2 = 6.5 | Im1 = 9.1–Im2 = 8.25–<br>Im' = 8.8 | 5.84 | 470 (8%) |
| 3 Concentric slots | R1 = 7.1<br>R2 = 6.5<br>R3 = 7.7 | I'm1 = 9.15–I'm2 = 8.55<br>I'm3 = 9.75<br>I"m = 8.8 | 5.8 | 550 (9.8%) |
| 2 Nested slots on the opposite side from the feed line | R'1 = 7.1<br>R'2 = 6.5 | I"m1 = 9.15–<br>I"m2 = 7.95–<br>I"m' = 8.25 | 5.72 | 450 (7.8%) |
| 3 Nested slots | R1 = 7.1<br>R2 = 6.5<br>R3 = 7.7 | I"m1 = 9.15–<br>I"m2 = 7.95<br>I"m3 = 10.34<br>I"m' = 8.25 | 5.59 | 500 (8.9%) |

It can be further increased by adding a third slot. A band of the order of 9% is then obtained as against 6.55% for the single slot. In all cases, the band maximum is obtained with the concentric slots configuration. However, this topology causes a spurious resonance at 1 GHz below the operating frequency of the structure (see FIG. 7). This is not the case for the nested slots configuration which could then be preferred to the concentric slots according to the spectral constraints imposed by the application. From the radiation point of view, the various topologies retain patterns and efficiencies which are conventionally obtained with a single annular slot.

Thus, the broadband character of the multislot structures has been validated on the novel topologies described above. The radiation is not disturbed by the arrangements proposed. The most effective topology in terms of band corresponds to a configuration of concentric slots. However, the latter configuration causes a spurious resonant frequency. This is not the case for the nested multislot topology. Although the latter is not as broadband as the concentric solution, it nevertheless makes it possible to obtain appreciable frequency bands relative to the single slot.

Figure 8A:
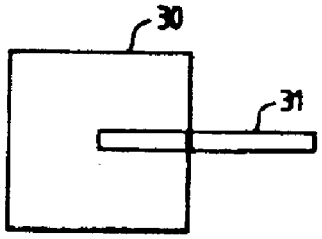
Figure 8B:
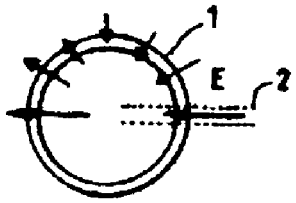
Figure 8C:
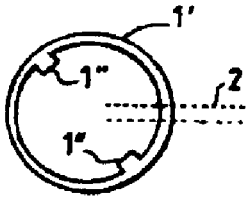

Various embodiments of the slots will now be described with reference to FIGS. 8*a*, 8*b*, 8*c*. In FIG. 8*a*, the slot consists of a square 30 fed by a line 31. In FIG. 8*b*, the slot 1 is circular. It is fed by a line 2 and it radiates a linearly polarized wave. In FIG. 8*c*, the circular slot 1' is furnished with notches 1". It is fed by a line 2. In this case, the slot radiates a circular polarization which may be left or right depending on the positioning of the feed line. It is obvious to the person skilled in the art that regardless of the shape of the slot, it must comply with the design rules given hereinabove. In a general manner, the slot must be symmetric with respect to a point and exhibit a length such that it radiates at the chosen fundamental frequency.

The present invention has been described with feed lines made in microstrip technology, however the lines may be made in coplanar technology.

What is claimed is:

1. Multiband planar antenna of the type comprising a first slot dimensioned to operate at a first frequency f1 and fed by a feed line positioned in such a way that the first slot lies in a short-circuit plane of the feed line, wherein it comprises at least one second slot dimensioned to operate at a second frequency f2, the second slot being fed by the said feed line positioned in such a way that the second slot lies in a short-circuit plane of said feed line.

2. Antenna according to claim 1, wherein it comprises N slots, each dimensioned to operate at a frequency fi with i varying from 1 to N, each slot being fed by the said feed line in such a way as to lie in a short-circuit plane of the feed line.

3. Antenna according to claim 1, wherein the slots are cotangent at a point with a feed situated at this point or at the diametrically opposite point.

4. Antenna according to claim 1, wherein the slots are concentric.

5. Antenna according to claim 1, wherein the length of each slot is chosen so that the slot resonates at the said frequency fi.

6. Antenna according to claim 5, wherein each slot is of symmetric shape with respect to a point.

7. Antenna according to claim 6, wherein each slot is circular or square.

8. Antenna according to claim 6, wherein the slots are furnished with means allowing the radiation of a circularly polarized wave.

9. Antenna according to claim 8, wherein the means consist of notches made in the slot.

10. Antenna according to claim 1, wherein the feed line is a microstrip line or a line made in coplanar technology.

* * * * *